US012577864B2

(12) United States Patent
Dusterhoft et al.

(10) Patent No.: US 12,577,864 B2
(45) Date of Patent: Mar. 17, 2026

(54) USING PRESSURE GAUGES TO ESTABLISH LOW FREQUENCY DISTRIBUTED ACOUSTIC SENSING RESPONSES ASSOCIATED WITH PRESSURE FIELD CHANGES IN OFFSET WELLS

(71) Applicant: Halliburton Energy Services, Inc., Houston, TX (US)

(72) Inventors: Ronald Glen Dusterhoft, Houston, TX (US); Robert Barree, Lakewood, CO (US); Awais Navaiz, Denver, CO (US); Mikko K. Jaaskelainen, Houston, TX (US); Jon Preston Doucette, Denver, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/441,976

(22) Filed: Feb. 14, 2024

(65) Prior Publication Data

US 2025/0257641 A1 Aug. 14, 2025

(51) Int. Cl.
*E21B 43/26* (2006.01)
*E21B 47/06* (2012.01)

(52) U.S. Cl.
CPC ..... *E21B 43/26* (2013.01); *E21B 47/06* (2013.01); *E21B 2200/20* (2020.05)

(58) Field of Classification Search
CPC ..... E21B 43/26; E21B 47/06; E21B 2200/20; E21B 49/00; E21B 47/107; E21B 43/12; E21B 21/08
See application file for complete search history.

(56) References Cited

U.S. PATENT DOCUMENTS 4,828,028 A 5/1989 Soliman
4,938,286 A 7/1990 Jennings, Jr.
5,025,859 A 6/1991 Hanson et al.
(Continued)

FOREIGN PATENT DOCUMENTS

CA 3086529 C * 11/2022 ..... E21B 47/107
CN 107939365 4/2018
WO 2025090086 5/2025

OTHER PUBLICATIONS

Navaiz, et al., "Delineating and Quantifying the Hydraulic Fracturing Energy System", SPE Oklahoma City Oil and Gas Symposium, Apr. 2023, 10 pages.
(Continued)

*Primary Examiner* — Zakiya W Bates
(74) *Attorney, Agent, or Firm* — DeLizio, Peacock, Lewin & Guerra LLP

(57) ABSTRACT

A hydraulic fracturing system and method uses a model trained with external pressure gauge data and LFDAS sensor data to identify pressure communication events based on LFDAS sensor data. One or more monitoring wells are established in proximity to a well undergoing well stimulation, each monitoring well including one or more LFDAS sensors. LFDAS sensor data is received from the LFDAS sensors of the one or more monitoring wells, the received LFDAS sensor data including data received after start of a well stimulation operation. Occurrences of pressure communication events at each monitoring well may then be identified based on the model and on the received LFDAS sensor data.

13 Claims, 5 Drawing Sheets

(56) References Cited

U.S. PATENT DOCUMENTS

| | | | | |
|---|---|---|---|---|
| 11,421,528 | B2 | 8/2022 | Ruhle et al. | |
| 11,697,759 | B1 | 7/2023 | Dusterhoft et al. | |
| 2003/0225522 | A1 | 12/2003 | Poe | |
| 2007/0272407 | A1 | 11/2007 | Lehman et al. | |
| 2010/0218941 | A1 | 9/2010 | Ramurthy et al. | |
| 2011/0307227 | A1 | 12/2011 | Poe | |
| 2012/0267104 | A1 | 10/2012 | Clarkson et al. | |
| 2012/0303342 | A1 | 11/2012 | Hazlett et al. | |
| 2013/0231910 | A1 | 9/2013 | Kumar et al. | |
| 2014/0048270 | A1 | 2/2014 | Soliman et al. | |
| 2015/0211347 | A1 | 7/2015 | Snider et al. | |
| 2016/0138371 | A1 | 5/2016 | Loaiza et al. | |
| 2017/0002652 | A1 | 1/2017 | Kampfer et al. | |
| 2017/0058613 | A1 | 3/2017 | Ling | |
| 2017/0241251 | A1 | 8/2017 | Rodrigues et al. | |
| 2018/0128091 | A1 | 5/2018 | Harper | |
| 2018/0149000 | A1 | 5/2018 | Roussel et al. | |
| 2019/0120022 | A1 | 4/2019 | Zanon et al. | |
| 2020/0319077 | A1 | 10/2020 | Moos et al. | |
| 2021/0189874 | A1* | 6/2021 | Jaaskelainen | E21B 47/135 |
| 2021/0231835 | A1* | 7/2021 | Ruhle | E21B 43/26 |
| 2021/0256183 | A1 | 8/2021 | Zhang et al. | |
| 2021/0364669 | A1 | 11/2021 | Dusterhoft et al. | |
| 2022/0325621 | A1 | 10/2022 | Moos et al. | |
| 2022/0364943 | A1* | 11/2022 | Sharma | G01K 11/32 |
| 2023/0012783 | A1 | 1/2023 | Jaaskelainen et al. | |
| 2023/0058311 | A1 | 2/2023 | Haustveit et al. | |
| 2024/0110472 | A1 | 4/2024 | Xia et al. | |
| 2024/0410261 | A1 | 12/2024 | Dusterhoft et al. | |
| 2024/0418412 | A1 | 12/2024 | Barree et al. | |
| 2025/0020048 | A1 | 1/2025 | Manchanda et al. | |
| 2025/0137365 | A1 | 5/2025 | Navaiz et al. | |

OTHER PUBLICATIONS

"U.S. Appl. No. 18/207,315 Final Office Action", Oct. 24, 2024, 24 pages.

"U.S. Appl. No. 18/207,315 Non-Final Office Action", Feb. 26, 2025, 28 pages.

"U.S. Appl. No. 18/207,315 Non-Final Office Action", Jun. 20, 2024, 27 pages.

Brannon, et al., "Newest State of the Art Neutrally Buoyant Proppant Facilitates Placement Throughout Created Vertical Fractures to Provide Substantial Production Uplift in Unconventional Wells", Unconventional Resources Technology Conference, held in Houston, Texas, USA, Jul. 26-28, 2021., Jul. 2021, 21 pages.

Trumpener, "Significant back-to-back earthquakes in northern B.C. 'very likely' caused by fracking: federal expert.", CBC News, Nov. 8, 2022, www.cbc.ca/news/canada/british-columbia/northern-bc-fracking-earthquakes-november-2022-1.6654969., Nov. 2022, 6 pages.

"PCT Application No. PCT/US2023/077980 International Search Report and Written Opinion", Jul. 22, 2024, 9 pages.

"U.S. Appl. No. 18/207,315 Final Office Action", Jul. 28, 2025, 45 pages.

* cited by examiner

USING PRESSURE GAUGES TO ESTABLISH LOW FREQUENCY DISTRIBUTED ACOUSTIC SENSING RESPONSES ASSOCIATED WITH PRESSURE FIELD CHANGES IN OFFSET WELLS

BACKGROUND

The oil and gas industry uses well stimulation techniques to increase the transfer of hydrocarbon resources from a reservoir formation to a wellbore. Such stimulation typically relies on the introduction of a pressurized fracturing fluid into a wellbore. The pressurized fracturing fluid generates fractures downhole in the reservoir formation. As part of the process, a flow network, sometimes referred to as "frac iron," is constructed between one or more pumps and a wellhead of a borehole. The flow network provides a path to deliver the pressurized fracturing fluid to the borehole so the fracturing fluid may be used to generate and propagate fractures in the reservoir formation.

BRIEF DESCRIPTION OF THE DRAWINGS

The disclosure may be better understood by referencing the accompanying drawings.

Like reference numbers and designations in the various drawings indicate like elements.

DETAILED DESCRIPTION

Figure 1:
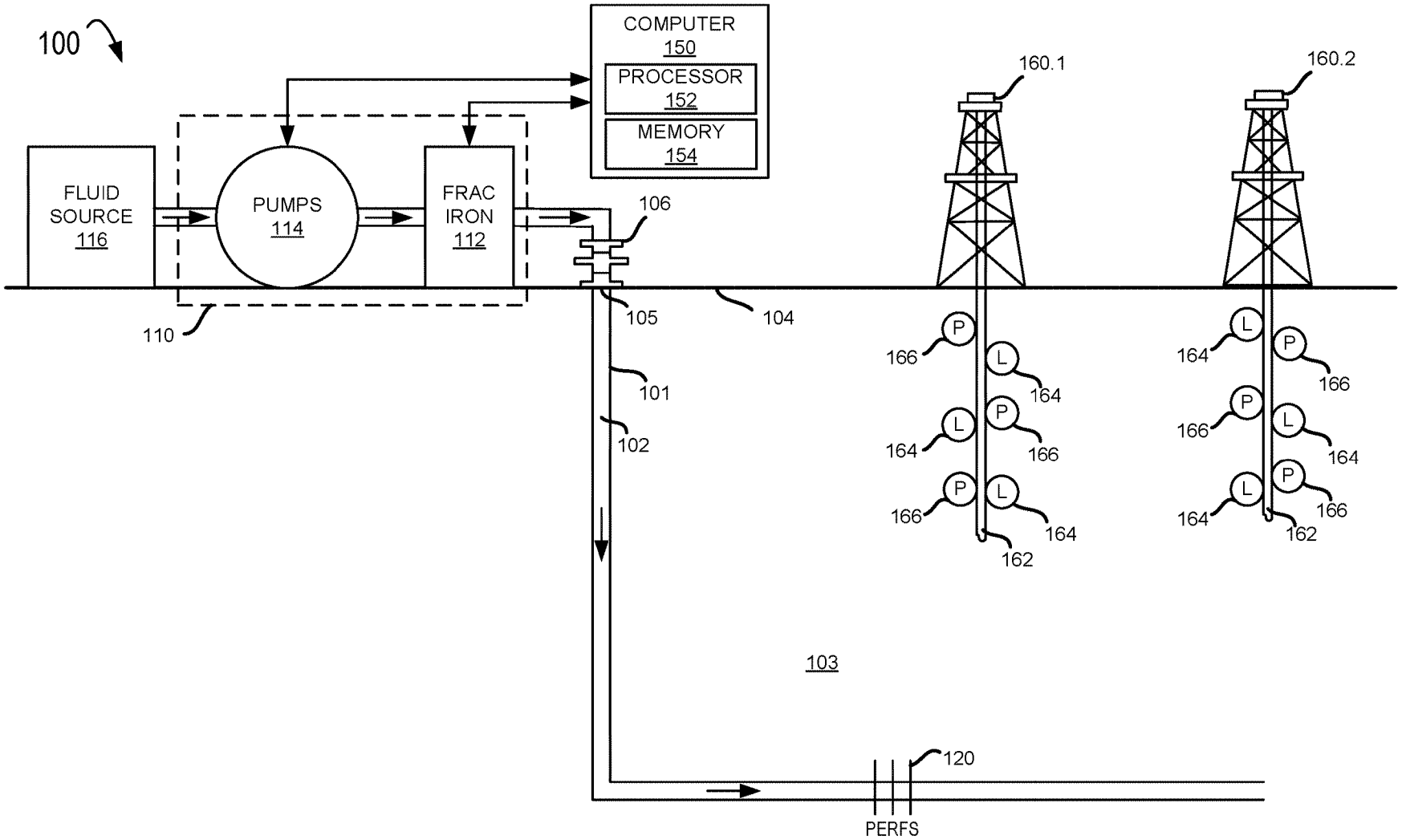
FIG. 1 illustrates an example well stimulation system, according to aspects of the present disclosure.

The description that follows includes example systems, methods, techniques, and program flows that embody embodiments of the disclosure. Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

Hydraulic fracturing is a form of energy transfer. In one example approach, the energy transfer initiates with hydraulic horsepower (via positive displacement pumps) that injects a unit volume of an incompressible fluid, carrying a certain volume fraction of proppant, into the wellhead. The process applies energy through compression to convert a low-pressure volume to a high-pressure state. Surface energy consumption is defined as the integration of the horsepower deployed over time. Integrating the horsepower deployed over time provides total surface energy consumption for the entire hydraulic pumping duration.

It can be difficult to balance formation development costs versus formation production. It's not enough to simply look at the total slurry and fluid volume delivered to a formation without taking into account the dynamic conditions in which fracturing jobs occur. One should instead look at well stimulation as an exchange of energy for production (in any form) within the formation. In one example approach, the energy consumed on the surface may be directly correlated to fuel consumed by the hydraulic horsepower and by the horsepower operating cost. This correlation is direct given the fact that fuel and horsepower maintenance may be valued in units of energy (e.g., MMBtu or MWh). The effective energy delivered to formation, however, is different from surface energy consumed since the unit volume of slurry that is pumped from the surface down the wellbore, past the perforations and into formation undergoes a series of energy losses and energy gains before reaching the formation. In practice, completion related variables are often changed with no regard to the impact on total energy consumption and related cost since that relationship is not understood. Similarly, the lack of understanding of effective energy delivered to formation prevents operators from making informed decisions regarding drill space unit (DSU) production optimization.

Furthermore, as a reservoir formation becomes more fractured, the effect of energy transfer into the formation becomes difficult to predict. It may be useful to further understand how energy transferred into the reservoir formation alters the formation; such information may be especially useful in optimizing complex fracture systems that are generated during the hydraulic fracture completion of single wells, multiple wells, multiple wells on a single pad, and multiple wells from multiple pads. Understanding how this energy is being dissipated in the reservoir and the upper effective limits of this energy may enable optimization of asset development all the way from well design to pad design and then on to completion sequencing and well production. In some cases, the optimum completion design may also change depending on when a given well is completed during the sequence of operations.

Current fracture models consider predominately Mode 1 types of failure, which is tension. Shale applications include multiple fractures along a horizontal wellbore. There may be significant stress interference between different fractures and the levels of stress increase significantly as fractures interfere with each other. High strain levels within regions of high stress interference can cause rock failure in shear that include Mode 2 (in plane shear failure) and Mode 3 (out of plane shear) types of failure. Dilation of Mode 2 and Mode 3 fractures creates a pressure field within the multi-mode fracture system that may be detected far away from the hydraulically initiated fractures themselves.

There are similar types of interference between multi-stage horizontal wells. In multi-stage horizontal wells, the amount of stress interference between stages and between different wells can become extreme. It may no longer be a reasonable assumption to rely on Mode 1 models since while Mode 1 failure will occur, shear and compressional failure will also occur resulting in a multi-mode fracture system. The result is a complex fracture system combining Mode 1, Mode 2, and Mode 3 failures. Open fractures may appear well away from the hydraulic fracture and significant pressure fields associated with the hydraulic fracture process may be detected a significant distance away from the hydraulic fracture.

Stress is transmitted through the rock very quickly, but pressure front development or pressure dissipation may be much slower as it is controlled by fracture dilation and leak-off into initially closed fracture systems within the sheared region. Pressure response lags the strain response. Once these fractures are open, however, the pressure signal moves faster. Either way the pressure field from hydraulic fracturing dissipates throughout the complex fracture system and can be used to understand the system itself. For the first wells in a system, the pressure front is mostly behind the newest fractures. After the first wells are fractured, however, the pressures will be much more interactive and connected. Interior wells, therefore, will behave much differently than those on the outside of the reservoir formation or on the outside of a given pad of wells or multiple pads of wells.

In one example approach, Low Frequency Distributed Acoustic Sensing (LFDAS) may be used to characterize a complex fracture system. The combination of pressure gauges and LFDAS sensors may also be used to characterize a complex fracture system. Finally, data collected from a combination of pressure gauges and LFDAS sensors may be used to train a LFDAS sensor-only system to better characterize a complex fracture system. For instance, it is possible to use external pressure gauges combined with LFDAS to identify specific distributed acoustic sensing (DAS) behaviors or patterns that are indicative of a pressure communication event so DAS can be used without pressure gauges to capture this information with LFDAS sensors alone in the future.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

Example Well Stimulation System

FIG. 1 illustrates an example well stimulation system, according to aspects of the present disclosure. A typical well stimulation system 100 includes one or more pumps 114 and a flow network connecting the pumps 114 through a borehole 102 to a reservoir formation 103. In operation, the flow network conveys pressurized fracturing fluid from the pumps to the reservoir formation. In general, fracturing fluids in well stimulation systems are injected into the wellbore at a high pressure in order to convey sufficient energy to a subterranean formation to cause fracturing in the formation. In some example approaches, well stimulation systems induce fluid pressures in a range of 3,000 to 20,000 pounds/square inch (psi) in the fluid injected into the wellbore with total slurry rate in the range of 10 to 200 barrels per min (bpm).

In the example shown in FIG. 1, well stimulation system 100 includes a frac iron configuration 110 connected through borehole 102 to reservoir formation 103. Frac iron configuration 110 includes frac iron 112 and one or more pumps 114. In the example approach shown in FIG. 1, frac iron 112 receives pressurized fracturing fluid pumped by the one or more pumps 114 from fluid source 116 and conveys the received pressurized fluid through borehole 102 to reservoir formation 103.

In some example approaches, borehole 102 includes a casing 101 and an opening 105 at surface 104. In some such example approaches, the pressurized fracturing fluid passes through an isolation valve 106 before entering borehole 102 at opening 105. In some example approaches, borehole 102 further includes perforations 120 at certain locations in reservoir formation 103, the pressurized fracturing fluid passing through the perforations 120 to cause fractures in the reservoir location 103.

In one example approach, well stimulation system 100 includes a computer system 150. In one such example approach, computer system 150 includes a processor 152 and a memory 154. In one example approach, instructions are stored in memory 154 that, when executed by processor 152, allow the processor 152 to control the fracturing process and to capture data representing pressure fields generated via fracking.

In one example approach the computer system 150 receives an effective energy model for energy loss in pressurized fracturing fluid passing into and through borehole 102 to a reservoir formation 103 during hydraulic fracturing. The model may be used to determine effective energy delivered to the reservoir formation as a function of surface energy added to the fracturing fluid to raise the fracturing fluid to a high-pressure state; gravitational potential energy gains in the pressurized fracturing fluid as the fluid travels down to the reservoir formation; and energy losses in the pressurized fracturing fluid as the fluid travels down to the reservoir formation. In one example approach, an operator may use computer system 150 to apply the effective energy model to a selected reservoir formation and may select, based on the effective energy model, an operational cost for hydraulic fracturing of the selected reservoir formation. The operator may then use the computer system to control the one or more pumps 114 in frac iron configuration 110 to achieve the selected operational cost.

As noted above, surface energy consumption may be expressed as units of energy. For instance, surface energy consumption may be expressed as horsepower times hours, or horsepower hours, which may be considered a unit of energy. The surface energy used in treatment of one or more wells may be calculated by multiplying pressure, rate, and operational time for the duration of the well treatment to arrive at surface horsepower hours consumed. Surface horsepower hours consumed may also be calculated by integrating pressure with respect to volume pumped for the duration of the treatment. That is, surface energy may be determined as the energy input to elevate a unit volume of slurry (fluid containing a certain volume fraction of proppant) from a low-pressure state to a high-pressure state.

As the unit volume of slurry traverses down borehole 102 it is met with assistance in the form of gravitational potential energy (hydrostatic pressure) and with resistance in the form of pipe friction. Additionally, when the unit of slurry flows past perforations 120 and near wellbore tortuous regions, the unit undergoes additional energy losses before reaching the formation. This relationship may be expressed via a derivation of Bernoulli's equation. Bernoulli's equation also adheres to conservation of energy. As a result, the pressure losses or gains may be represented in terms of energy if the individual terms of Bernoulli's equation are integrated with respect to volume.

This then becomes the backbone of hydraulic fracturing energy analyses, where the effective energy delivered to the formation may be calculated by adding gravitational potential energy to the surface energy component and subtracting all the energy loss contributions (e.g., pipe friction and perforation friction). As noted above, the energy received at the perforations 120 is not all converted to Mode 1 fractures. Some is lost at the perforations 120 and via tortuosity/near wellbore (NWB). The remainder is dissipated as a pressure field generated via Mode 2 and Mode 3 fractures in the vicinity of the Mode 1 fractures.

By understanding this energy system and applying completion strategies and technologies to reduce system losses such as pipe friction, perforation friction, NWB losses and pressure field propagation, one may lower surface energy consumption while maintaining or improving the effective energy delivered bottomhole. As the ratio of effective energy downhole to surface energy is maximized, so is the ratio of effective energy to operational cost maximized.

Low Frequency Distributed Acoustic Sensing (LFDAS) may be used in the presence of external pressure gauges to detect DAS behaviors or patterns that are indicative of a pressure communication event. Data captured by the LFDAS sensors and by the external pressure gauges may then be correlated using a physics-based method and/or used to train a machine learning system such as a neural network to operate solely with LFDAS sensors to detect such DAS behaviors in the absence of external pressure gauges. The machine learning process may include supervised and unsupervised learning approaches. In some example approaches, the pressure data may be processed and tagged with events of interest. In some such approaches, the events of interest include deviations from a static base line, deviations from a slowly declining pressure rate as pressure bleeds off into the formation, rate of pressure changes where different rates of change may indicate different events (e.g. an approaching fracture with a slow rate of pressure increase or a fracture intersecting a pressure gauge where the rate of pressure change can be associated with the location of the fracture, sudden drops in pressure during fracturing operations where the pressure drop may be associated with fault activation, or gradual changes to pressure rates as fractures may intersect existing fracture networks). These tags may then be used for supervised machine learning approaches. The tagged events may include events flagged and/or removed/ignored during unsupervised learning where the machine learning model development process identifies similar events and groups them in order to identify features that may then be classified by a subject matter expert and used for supervised learning approaches. These pressure events and features may then be used to train a machine learning model where, for instance, the strain data is used as the measured/applied as input data in cases where external pressure gauges may not be available or coarsely spaced. Data from fracture operations may also be included in the data set and one or more of treatment well pressure, rate, fluid chemical composition, completion parameters, target formation, microseismic data captured with Distributed Acoustic Sensing (DAS) systems/geophone/accelerometers and associated processed data, treatment well flow allocation and uniformity index using DAS, instantaneous and cumulative flow rate per cluster, formation parameters like depth/permeability/porosity/reservoir rock/temperature/pressure and geographical data like GPS position for formation specific models. This approach of building machine learning models where strain may be used as a proxy or a substitute for pressure enables the use of distributed sensing where the distributed fiber may be deployed on demand during fracturing operations using, for instance, the Halliburton ExpressFiber service whereas externally ported pressure sensors are deployed during the completion phase of a well.

In the example shown in FIG. 1, monitoring wells 160.1 and 160.2 (collectively, monitoring wells 160) include a borehole 162. Borchole 162 includes LFDAS sensors 164 and external pressure gauges 166. During fracking operations, sensors 164 monitor for DAS behaviors or patterns that are indicative of a pressure communication event while pressure gauges 166 monitor for the pressure communication event itself. In one example approach, the data is stored and correlated using a physics-based method and/or used to train a machine learning system such as a neural network. In some such example approaches, data captured from LFDAS sensors 164 and external pressure gauges 166 is stored in memory 154. In one example approach, the stored data may be correlated using a physics-based method. In another example approach, the stored data may be used to train a machine learning system executing on processor 152. Use of external pressure gauges 166 combined with LFDAS sensors 164 to identify specific DAS behaviors or patterns that are indicative of a pressure communication event make it so DAS can be used without pressure gauges to capture this information in the future. Monitoring wells 160 may be installed in adjacent well pads to capture information regarding the level of stress and pressure interference between pads and to provide vital information to help optimize treatments for a new pad. Since pressure communication events may spread out over a much larger area along the wellbore 102 than is usually associated with Mode 1 fracturing, such an approach is less expensive than the combination of LFDAS sensors 164 and pressure gauges 166, while presenting accurate detection of the scope of the pressure field around the fracturing event. In addition, new wells added to the fractured and energized region may be completed with much smaller fracturing treatments to connect to the already fractured reservoir formation 103.

Figure 2:
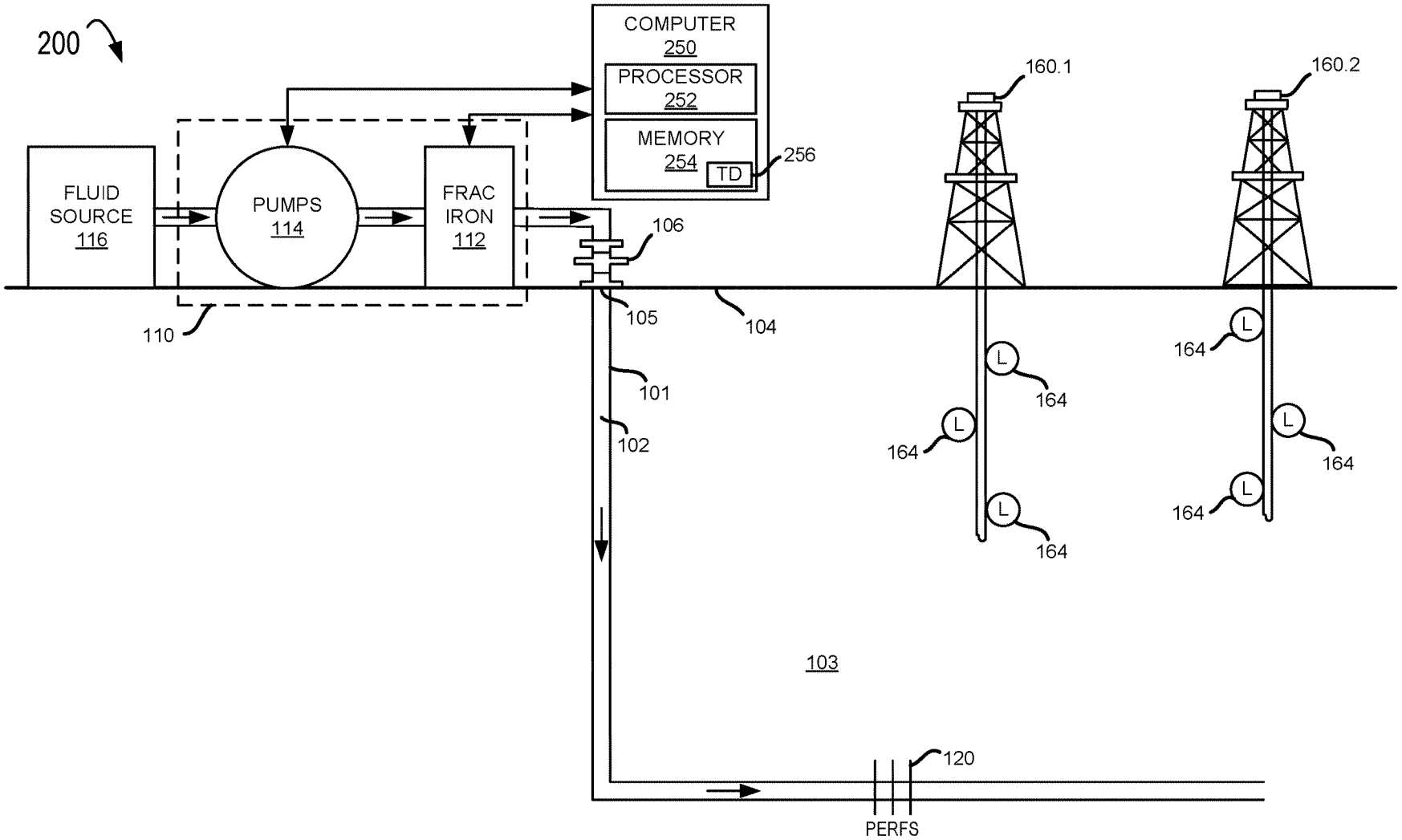
FIG. 2 illustrates another example approach to a well stimulation system, according to aspects of the present disclosure.

FIG. 2 illustrates another example approach to a well stimulation system, according to aspects of the present disclosure. As in the well stimulation system 100 of FIG. 1, well stimulation system 200 includes one or more pumps 114 and a flow network connecting the pumps 114 through a borehole 102 to a reservoir formation 103. In operation, the flow network conveys pressurized fracturing fluid from the pumps to the reservoir formation. In general, fracturing fluids in well stimulation systems are injected into the wellbore at a high pressure in order to convey sufficient energy to a subterranean formation to cause fracturing in the formation. In some example approaches, well stimulation systems induce fluid pressures in a range of 3,000 to 20,000 pounds/square inch (psi) in the fluid injected into the wellbore with total slurry rate in the range of 10 to 200 barrels per min (bpm).

In the example shown in FIG. 2, well stimulation system 200 includes a frac iron configuration 110 connected through borehole 102 to reservoir formation 103. Frac iron configuration 110 includes frac iron 112 and one or more pumps 114. In the example approach shown in FIG. 2, frac iron 112 receives pressurized fracturing fluid pumped by the one or more pumps 114 from fluid source 116 and conveys the received pressurized fluid through borehole 102 to reservoir formation 103.

In some example approaches, borehole 102 includes a casing 101 and an opening 105 at surface 104. In some such example approaches, the pressurized fracturing fluid passes through an isolation valve 106 before entering borehole 102 at opening 105. In some example approaches, borehole 102 further includes perforations 120 at certain locations in reservoir formation 103, the pressurized fracturing fluid passing through the perforations 120 to cause fractures in the reservoir location 103.

In one example approach, well stimulation system 200 includes a computer system 250. In one such example approach, computer system 250 includes a processor 252 and a memory 254. In one example approach, instructions are stored in memory 254 that, when executed by processor 252, allow the processor 252 to control the fracturing process and to capture data representing pressure fields generated via fracking. In one such example approach, memory 254 further includes instructions stored in memory 254 that, when executed by processor 252, allow the processor 252 to execute a machine learning system that receives training data 256 stored in memory 254 and generates a model for interpreting LFDAS sensor data to detect and measure pressure communication events as discussed above. Processor 252 then uses the model to process LFDAS signals received during stimulation of the reservoir formation 103.

In one example approach the computer system 250 receives an effective energy model for energy loss in pressurized fracturing fluid passing into and through borehole 102 to a reservoir formation 103 during hydraulic fracturing. The model may be used to determine effective energy delivered to the reservoir formation as a function of surface energy added to the fracturing fluid to raise the fracturing fluid to a high-pressure state; gravitational potential energy gains in the pressurized fracturing fluid as the fluid travels down to the reservoir formation; and energy losses in the pressurized fracturing fluid as the fluid travels down to the reservoir formation. In one example approach, an operator may use computer system 150 to apply the effective energy model to a selected reservoir formation and may select, based on the effective energy model, an operational cost for hydraulic fracturing of the selected reservoir formation. The operator may then use the computer system to control the one or more pumps 114 in frac iron configuration 110 to achieve the selected operational cost.

In the example shown in FIG. 2, monitoring wells 160.1 and 160.2 (collectively, monitoring wells 160) include a borehole 162. Borchole 162 includes LFDAS sensors 164. During fracking operations, computer system 250 uses sensors 164 to monitor DAS behaviors or patterns that are indicative of a pressure communication event. In one example approach, the LFDAS signal data is stored and analyzed by processor 252 using the model for interpreting LFDAS sensor data.

In one example approach, monitoring wells 160 equipped with LFDAS sensors 164 are established throughout the reservoir formation 103 to capture information representing pressure interference between pads and to provide vital information to help optimize treatments for a new pad. Such an approach is less expensive than the combination of LFDAS sensors 164 and pressure gauges 166 discussed in FIG. 1, while presenting accurate detection of the scope of the pressure field around the fracturing event.

Figure 3:
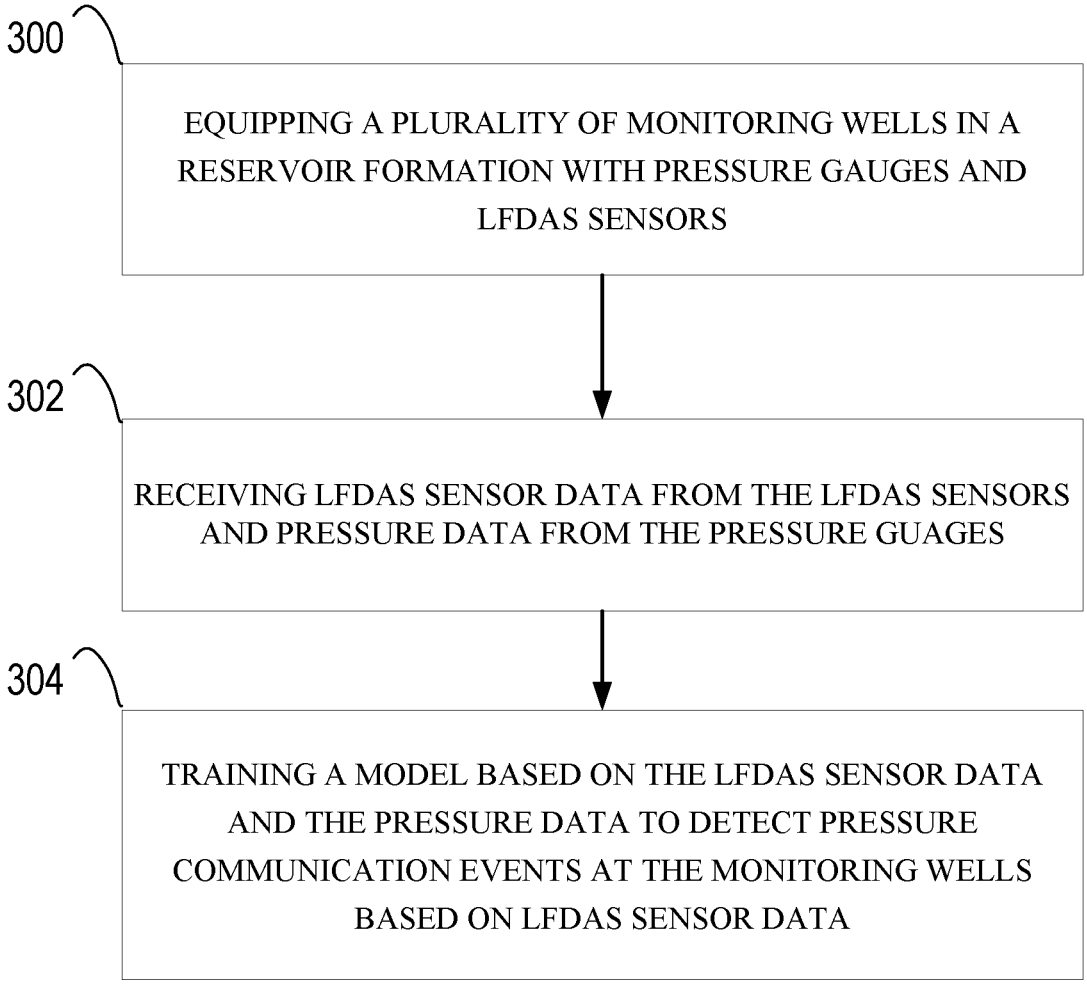
FIG. 3 is a flow diagram illustrating an example method of training a model for processing LFDAS sensor data to detect pressure events, according to aspects of the present disclosure.

FIG. 3 is a flow diagram illustrating an example method of training a model for processing LFDAS sensor data, according to aspects of the present disclosure. At present, LFDAS information is used simply to identify fracture hits on offset wellbores and, especially, in the area where we expect interference events. There are, however, many other responses hidden in the LFDAS data along a much larger portion of the wellbore.

Current approaches of monitoring fracture hits via LFDAS sensor data are focused on identifying fracture hits within a very localized area; the energy dynamics of fracking, however, occur on a pad/reservoir scale over time. Core through experiments agree, with more fractures observed than would be expected based on conventional fracture theory.

When external pressure gauges are mounted on the same wellbore as the LFDAS, a correlation can be seen between apparent LFDAS responses and changes in local pressure both in time and space. This correlation suggests the presence of a large "pressure field" that exists both within and outside of the fractured region. External pressure gauges may be used to identify the relationship between LFDAS sensor data and the external pressure field so that LFDAS may ultimately be used without pressure gauges to identify the presence and extent of the pressure field developing within the shear fracture field created during hydraulic fracturing operations.

What is shown in FIG. 3 is the use of external pressure gauges to identify specific LFDAS responses that are associated with pressure gauge responses along the wellbore. With this information the goal is to identify specific behaviors using only LFDAS in the future, helping to reduce the cost of future jobs while still enabling more detailed analysis via the LFDAS. The goal is to use LFDAS to map an induced shear fracture field and induced pressure field around an offset monitoring wellbore. This information may be used to alter the completion treatments being conducted on the current treatment well and to modify the treatment designs for the monitoring well and other offset wells when the current wellbore is completed.

In the example approach shown in FIG. 3, monitoring wells in a reservoir formation are equipped with external pressure gauges 166 and LFDAS sensor 164 (300). A fracking operation is initiated and data corresponding to the effect of the fracking operation is received from the external pressure gauges and the LFDAS sensors (302). The data includes information from both the pressure gauges and the LFDAS sensors on changes in pressure at the monitoring wellbores. Computer system 150 is trained using the pressure gauge data and the LFDAS sensor data to determine, from the LFDAS sensor data, pressure communication events (304). In some example approaches, the LFDAS sensor data is also used to characterize a pressure field close to the monitoring wellbore, creating a pressure profile in the vicinity of the monitoring wellbore.

Using external pressure gauges to train a computer tool to identify pressure events using only LFDAS sensor data provides a mechanism for characterizing pressure fields in the vicinity of the monitoring wellbores. This information may be used to make decisions in real time with respect to treatment size (volume) and completion sequencing (completion order or sequence). It may also be used to relate the energy injected into the reservoir formation to the internal pressure field(s), allowing the operator to optimize development planning. Measured data may indicate energy and activity outside the fractured area, i.e. hundreds to thousands of meters away from the actual fractures that are generated. The data may be captured with distributed fiber optic measurements covering a substantial portion of the wellbore and processed to Low Frequency Distributed Acoustic Sensing (LFDAS) data or captured with pressure gauges suitably placed along the wellbore. This data hundreds to thousand meters away from the fracture zone may indicate energy loss and machine learning models may be trained to identify conditions that minimize energy loss, and provide machine learning model outputs that can be used to control fracturing operations. The machine learning models may be trained to identify events and energy close in depth to the treated perforation clusters e.g. within tens to hundreds of meters of expected fractures locations (in zone) where the majority of the effective energy should be placed, and also identify events and energy (i.e. energy loss) in areas hundreds to thousands of meters away from the expected fracture locations (out of zone) to generate a measure of out of zone energy loss. The relationship of placed energy vs. depth may be used to control fracturing operations and improve energy efficiency in fracturing operations. The system and method can be used to compare energy placement between two or more zones, and control the frac spread to minimize out of zone energy placement. The energy placement metric can also be used to compare different completions and the machine learning model can be used to simulate various completion and treatment scenarios.

Figure 4:
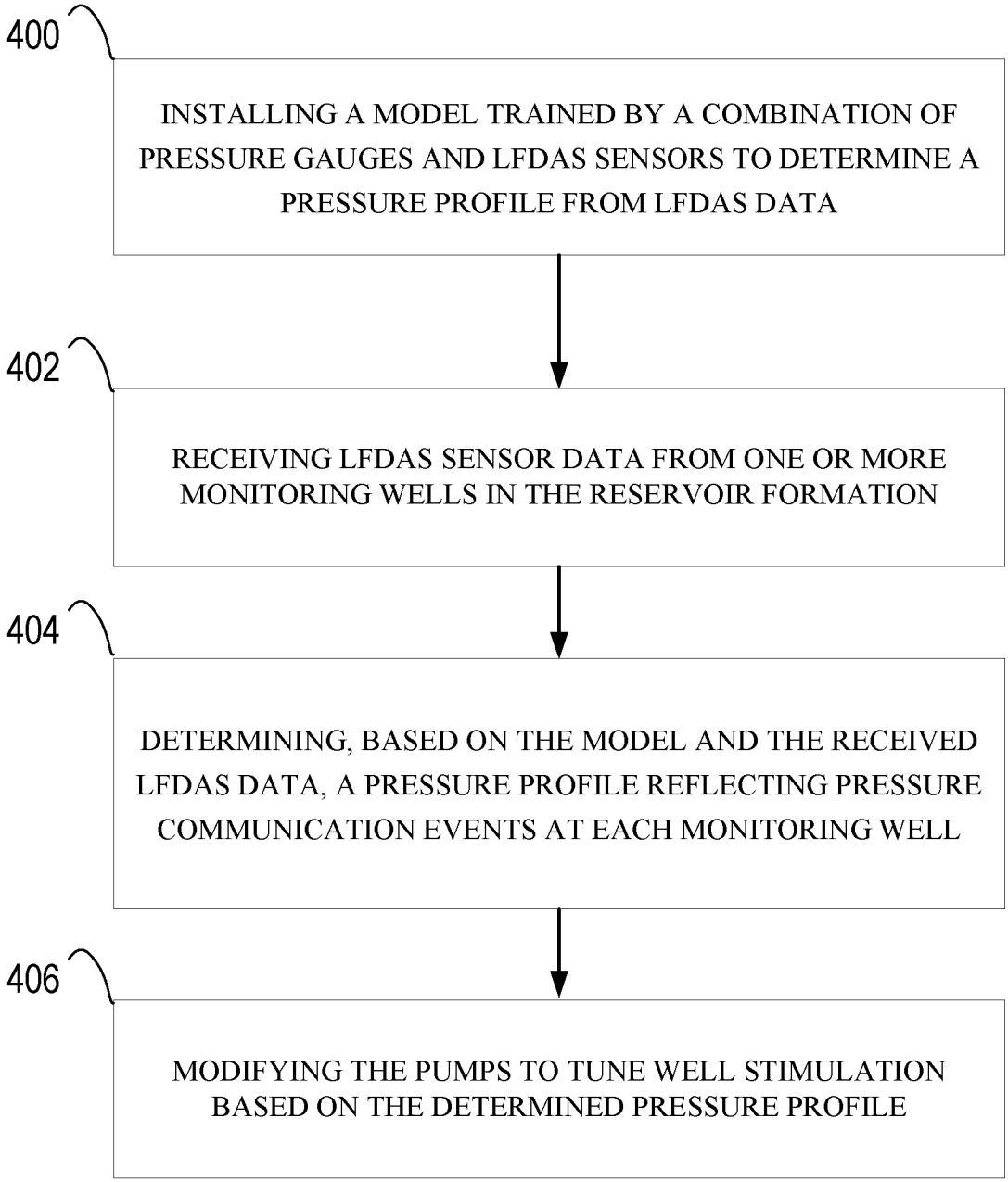
FIG. 4 is a flow diagram illustrating an example application of a model for processing LFDAS sensor data to detect pressure events, according to aspects of the present disclosure.

FIG. 4 is a flow diagram illustrating an example method of using a model to process LFDAS sensor data, according to aspects of the present disclosure. As noted above, there is a direct relationship between the external pressure gauges and the LFDAS response of fiber strain sensing. That relationship may be used to capture more information along the entire wellbore during hydraulic fracturing operations and not just to identify a specific fracture hit. Capturing and mapping changes in the strain behavior along the entire wellbore makes it possible to observe vital information regarding complex fracture and pressure interactions between multiple wellbores. This understanding may be used to make more informed decisions on how to best sequence completion operations to either minimize the degree of fracture interaction or to increase the degree of fracture interaction depending on the specific needs in any given region.

In the example method of FIG. 4, a model is installed (400) in computer system 250. In one example approach, the model is a trained by experts to identify pressure communication events in LFDAS sensor data by comparisons to external pressure data. In another example approach, computer system 250 includes a machine learning system that applies the pressure gauge data and the corresponding LFDAS data to the machine learning system to train the machine learning system to identify from the LFDAS sensor data the pressure events found in the pressure gauge data. In some such example approaches, the machine learning system may include a neural network trained on the pressure gauge data and the LFDAS sensor data to identify pressure events based solely on the LFDAS sensor data. In another example approach, computer system 250 includes a physics-based method that correlates the pressure gauge data and the corresponding LFDAS data to identify from the LFDAS sensor data the pressure events found in the pressure gauge data. In some such example approaches, the machine learning system may be combined with a physics-based method trained on the pressure gauge data and the LFDAS sensor data to identify pressure events based solely on the LFDAS sensor data. In some example approaches, the model is tested with known LFDAS sensor data to determine the accuracy of the model.

Computer system 250 receives LFDAS sensor data corresponding to a fracking event (402) and determines, based on the model and the received LFDAS sensor data, a pressure profile reflecting pressure events at each monitoring well (404). Pumps 114 may then be modified to tune well stimulation in real time based on the pressure profile. Changes in real time include changing treatment volumes, flowing back some completed wells before completing others, and moving operations to new wells to let the system stabilize before finishing the initial well. In today's environment, the pressure builds up to a point near overburden pressure where it will stabilize, possibly limiting the ability to inject more energy into the system. Flowing back at that point allows the fracking system to insert more energy into the system by venting pressure from already completed wells to enable more vertical connectivity to be created within the system.

The LFDAS sensor monitoring described in FIG. 4 may be used in a variety of ways. In contrast to modern approaches, which look for events close to when one would expect interference events, data may now be monitored over a longer interval. Events such as 1) slow strain and/or pressure buildup, 2) increases in the rate of strain change or pressure build-up (occurs when a fracture approaches), 3) mechanical communication corresponding to when pumping starts, 4) pressure/strain response when natural fractures open, 5) activation of the fracture network when natural fractures occur 6) activation of non-critically stressed faults or critically stressed faults that can act as pressure sinks by creating pathways to new or untreated formation, all may be monitored and interpreted to gain an understanding of the state of the reservoir formation. This may include supervised and unsupervised learning to identify and classify the events. Similar events may be detected during flow-back, and the same supervised learning used on events identified during treatment alternating with flowback. The events during flowback may have different frequency and amplitude characteristics as the rate of flowback is lower than the rate of fracture treatment/injection. In one example approach, multiple wells may be flowed back simultaneously while one well, or multiple wells are treated. Unsupervised learning may be applied to the full data set or to a subset where the supervised events are removed. The new measured events may then be tied to models like, for example, GOHFER.

Metrics like Volume to First Response (VFR) may be used, in some examples, to quantify events, Other calculated variable may include pressure gradient fields to allow calculation of required energy to fracture future stages to determine when a well may be flowed back to reduce pressure in a reservoir segment with associated treatment pressure reduction. Changes to reservoir pressure gradient fields between wells may also allow spot treatments between high pressure and lower pressure regions, or calculation of efficiency metrics enabling engineered fracturing treatment decisions. Well treatment sequences, rates, volumes, flowback order, flowback volumes, etc., may be planned for with initial assumptions of reservoir properties and adjusted based on actual measured data.

Figure 5:
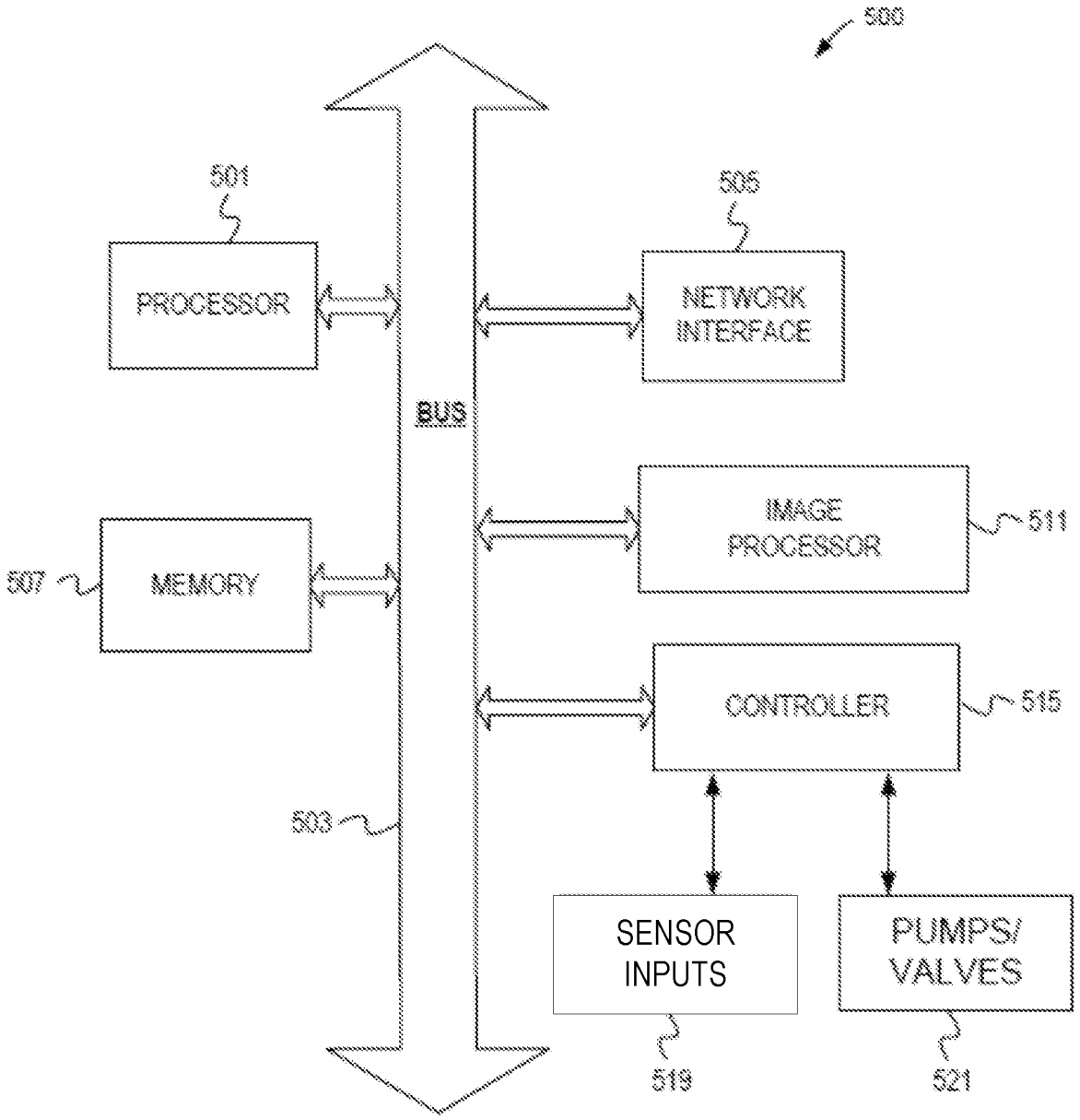
FIG. 5 illustrates a computer system that may be used as the computer system in FIGS. 1 and 2.

FIG. 5 illustrates a computer system that may be used as the computer system 150 in FIG. 1 and the computer system 250 of FIG. 2. Computer system 500 may be employed to practice the concepts, methods, and techniques disclosed herein, and variations thereof. In one example approach, computer system 500 includes a plurality of components in electrical communication with each other, in some examples using a bus 503. The computing system 500 may include any suitable computer, controller, or data processing apparatus capable of being programmed to carry out the method and apparatus as further described herein.

In one example approach, computing system 500 may be a general-purpose computer, and may include a processor 501 (possibly including multiple processors, multiple cores, multiple nodes, and/or implementing multi-threading, etc.). In one such example approach, computer system 500 includes a memory 507. The memory 507 may be system memory (e.g., one or more of cache, SRAM, or DRAM) or any one or more of the possible realizations of machine-readable media. Computer system 500 also includes bus 503 (e.g., PCI, ISA, PCI-Express, etc.) and a network interface 505 (e.g., ethernet or Fiber Channel).

The computer may also include an image processor 511 and a controller 515. The controller 515 may control the different operations that can occur in response to data received at sensor inputs 519 and/or calculations based on data received from sensor inputs 519 (such as data from sensors used to sense, for instance, LFDAS sensor data received from LFDAS sensor 164 of FIG. 2) using any of the techniques described herein, and any equivalents thereof, to provide outputs to control pumps 114 and valves in frac iron 110. In some example approaches, controller 515 may communicate instructions to the appropriate equipment, devices, etc. to alter control number and/or the horsepower setting use by the pumps (such as pumps 114 in FIG. 1) that may be utilized in a fracturing procedure. Any one of the previously described functions may be partially (or entirely) implemented in hardware and/or on the processor 501. For example, the functions may be implemented with an application specific integrated circuit, in logic implemented in the processor 501, in a co-processor on a peripheral device or card, etc. Further, realizations may include fewer or additional components not illustrated in FIG. 5 (e.g., video cards, audio cards, additional network interfaces, peripheral devices, etc.). As illustrated in FIG. 5, the processor 501 and the network interface 505 are coupled to the bus 503. Although illustrated as also being coupled to the bus 503, the memory 507 may be coupled to the processor 501 only, to both processor 501 and bus 503 or to processor 501, image processor 511 and bus 503. Controller 515 may be coupled to sensor inputs 519 and to pumps 114 using any type of wired or wireless connection(s), and may receive data, such as measurement data, obtained by sensors inputs 519, LFDAS sensors 164 or provided by the pumps 114 at pumps/valves 521. Sensor inputs 519 may include any of the sensors associated with a wellbore environment, including but not limited to the pressure sensors configured to output signals indicative of pressure level within a frac iron configuration. Controller 515 may include circuitry, such as analog-to-digital (A/D) converters and buffers that allow controller 515 to receive electrical signals directly from one or more of sensor inputs 519.

Processor 501 may be configured to execute instructions that provide control over the pressurized fluid fracturing procedures described in this disclosure, and over any equivalents thereof. For example, processor 501 may control operations of one or more pumps 114 being utilized to pressurize a frac iron configuration as part of a fracturing procedure. Control of pumps may include determining a set of predefined pump configurations, wherein a particular one of the predefined pump configurations are assigned to be used during each of a plurality of pressure testing cycles, and providing output signal, for example to controller(s) located at the pumps 114, to configure and control the operations of the pumps during the duration of the procedure according to the predefined pump configuration that is to be applied to that particular pressure testing cycle.

With respect to computing system 500, basic features here may easily be substituted for improved hardware or firmware arrangements as they are developed. In some examples, memory 507 includes non-volatile memory and can be a hard disk or other types of computer readable media which can store data that are accessible by a computer, such as magnetic cassettes, flash memory cards, solid state memory devices, digital versatile disks (DVDs), cartridges, RAM, ROM, a cable containing a bit stream, and hybrids thereof.

It will be understood that one or more blocks of the flowchart illustrations and/or block diagrams, and combinations of blocks in the flowchart illustrations and/or block diagrams, may be implemented by program code. The program code may be provided to a processor of a general-purpose computer, special purpose computer, or other programmable machine or apparatus. As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. While depicted as a computing system 400 or as a general-purpose computer, some embodiments can be any type of device or apparatus to perform operations described herein.

Example Operations

Installation of LFDAS monitoring in offset pad wells adjacent to or close to the current pad where completion operations are being conducted may be used to determine if the shear fracture field from the current operations are detected in monitoring wells in the adjacent pads. If the fracturing treatments from Pad A are detected on Pad B, then the preferred sequence of operations for Pad B may be changed to take advantage of the fractures originating from Pad A. In one example approach, this may include treating outside wells from Pad B that have been contacted by wells from Pad A with smaller fracture treatments to connect to the pre-existing fractures from Pad A, helping to reduce the cost and the operations on Pad B wellbore. In another example approach, larger treatments on Pad B may be performed on interior wells that have not been contacted by the treatments at Pad A.

Alternatively, if wells from Pad A have impacted wells from Pad B, it may be desirable to flow back the wells from Pad A to reduce the pressure within the created shear fracture field before fracturing wells on Pad B. Doing this may enable Pad B to be completed in a more normal stress and pressure state.

Finally, in areas where there are a lot of stress and pressure interference between multiple wellbores and several wells are being completed with smaller fracture treatments, it may be desirable to reduce the spacing between interior wellbores to increase the number of drainage points and increase the recovery factor of the reservoir.

It is becoming increasingly important to understand how the energy put into a reservoir formation alters the formation. The LFDAS sensing operation described above may be vital in characterizing complex fracture systems that are generated during hydraulic fracture completion of single wells, multiple wells, multiple wells on a single pad and multiple wells on multiple pads. Understanding how this energy is being dissipated in the reservoir and the upper effective limits of this energy may enable the optimization of asset development all the way from well design to pad design and then on to completion sequencing and well production. In some cases the optimum completion design may also change depending on when a given well is completed during the sequence of operations. The approaches described above provide methods for obtaining more value out of collected strain fiber data, smarter use of the data and enabling new pad/reservoir treatment approaches currently not available on the market. The system scales well and may provide new reservoir-scale insights on propagation of fractures in the reservoir formation. Wells subjected to an intelligent sequence of operations reflecting pressure field propagation may lead to reduced pressure and improved well performance and longevity.

Various modifications to the implementations described in this disclosure may be readily apparent to persons having ordinary skill in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Additionally, various features that are described in this specification in the context of separate implementations also can be implemented in combination in a single implementation. Conversely, various features that are described in the context of a single implementation also can be implemented in multiple implementations separately or in any suitable subcombination. As such, although features may be described above as acting in particular combinations, and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the order shown or in sequential order, or that all illustrated operations be performed, to achieve desirable results. Further, the drawings may schematically depict one or more example processes in the form of a flowchart or flow diagram. However, other operations that are not depicted can be incorporated in the example processes that are schematically illustrated. For example, one or more additional operations can be performed before, after, simultaneously, or between any of the illustrated operations. In some circumstances, multitasking and parallel processing may be advantageous. Moreover, the separation of various system components in the implementations described above should not be understood as requiring such separation in all implementations, and the described program components and systems can generally be integrated together in a single software product or packaged into multiple software products. Additionally, other implementations are within the scope of the following claims. In some cases, the actions recited in the claims can be performed in a different order and still achieve desirable results.

EXAMPLE EMBODIMENTS

Embodiment #1: A method, comprising establishing, in a reservoir formation, one or more monitoring wells in proximity to a well undergoing well stimulation, at least one of the monitoring wells including one or more pressure gauges and one or more LFDAS sensors; starting a well stimulation operation at the well undergoing well stimulation; collecting, at the at least one monitoring well, data associated with the well stimulation operation, wherein the data includes: information collected from the pressure gauges; and information collected from the LFDAS sensors; and training a model to detect pressure communication events in monitoring wells based on information collected from LFDAS sensors, the training based on the information collected from the pressure gauges and the information collected from the LFDAS sensors.

Embodiment #2: The method of embodiment #1, wherein the LFDAS sensor data includes strain fiber data.

Embodiment #3: The method of embodiment #1, wherein the model is a machine learning model.

Embodiment #4: The method of embodiment #1, wherein the model is a neural network.

Embodiment #5: The method of embodiment #1, wherein training the model includes tagging the data with labels and training the model based on the tagged data.

Embodiment #6: The method of embodiment #1, wherein the method further includes training the model to map an induced shear fracture field and an induced pressure field around each monitoring well based on the LFDAS sensor data.

Embodiment #7: The method of embodiment #1, wherein the method further includes detecting one or more pressure communication events at one or more of the monitoring wells and modifying the well stimulation operation based on the detected pressure communication events.

Embodiment #8: The method of embodiment #1, wherein the model correlates the pressure gauge data and the corresponding LFDAS data to identify the pressure events found in the pressure gauge data through the LFDAS sensor data.

Embodiment #9: A method, comprising installing a model, the model trained with external pressure gauge data and LFDAS sensor data to identify pressure communication events based on LFDAS sensor data; establishing, in a reservoir formation, one or more monitoring wells in proximity to a well undergoing well stimulation, each monitoring well including one or more LFDAS sensors; receiving LFDAS sensor data from the LFDAS sensors of the one or more monitoring wells, the received LFDAS sensor data including data received after start of a well stimulation operation; and identifying, based on the model and on the received LFDAS sensor data, occurrences of pressure communication events at each monitoring well.

Embodiment #10: The method of embodiment #9, wherein the LFDAS sensor data includes strain fiber data.

Embodiment #11: The method of embodiment #9, wherein the method further includes modifying the well stimulation operation based on information associated with the identified pressure communication events.

Embodiment #12: The method of embodiment #9, wherein the model is a machine learning model.

Embodiment #13: The method of embodiment #9, wherein the model is a neural network.

Embodiment #14: The method of embodiment #9, wherein the method further includes detecting one or more pressure communication events at one or more of the monitoring wells and modifying the well stimulation operation based on the detected pressure communication events.

Embodiment #15: The method of embodiment #9, wherein the method further includes mapping an induced shear fracture field and an induced pressure field around each monitoring well based on the LFDAS sensor data.

Embodiment #16: The method of embodiment #9, wherein the method further includes detecting one or more pressure communication events at one or more of the monitoring wells and modifying the well stimulation operation based on the detected pressure communication events.

Embodiment #17: A well stimulation system comprising one or more pumps, the pumps configured to pressurize fracturing fluid received from a fluid source and to direct the pressurized fracturing fluid down a borehole to a reservoir formation; one or more monitoring wells in the reservoir formation and in proximity to the borehole, each monitoring well including one or more LFDAS sensors; and a computer system having a processor and a memory, the memory including instructions that, when executed by the processor, cause the processor to install a model, the model trained with external pressure gauge data and LFDAS sensor data to identify pressure communication events based on data from LFDAS sensors; receive LFDAS sensor data from the LFDAS sensors of the one or more monitoring wells, the received LFDAS sensor data including data received after start of a well stimulation operation; and identify, based on the model and on the received LFDAS sensor data, occurrences of pressure communication events at each monitoring well.

Embodiment #18: The system of embodiment #17, wherein the instructions further include instructions that, when executed by the processor, cause the processor to modify the well stimulation operation based on information associated with the identified pressure communication events.

Embodiment #19: The system of embodiment #17, wherein the instructions further include instructions that, when executed by the processor, cause the processor to map an induced shear fracture field and an induced pressure field around each monitoring well based on the LFDAS sensor data.

Embodiment #20: A non-transitory computer readable medium storing instructions that, when executed by a computer cause the computer to install a model, the model trained with external pressure gauge data and LFDAS sensor data to identify pressure communication events based on LFDAS sensor data; establish one or more monitoring wells in proximity to a well undergoing well stimulation, each monitoring well including one or more LFDAS sensors; receive LFDAS sensor data from the LFDAS sensors of the one or more monitoring wells, the received LFDAS sensor data including data received after start of a well stimulation operation; and identify, based on the model and on the received LFDAS sensor data, occurrences of pressure communication events at each monitoring well.

Embodiment #21: The non-transitory computer readable medium of embodiment #20, wherein the instructions further include instructions that, when executed by the computer cause the computer to modify the well stimulation operation based on information associated with the identified pressure communication events.

Embodiment #22: The non-transitory computer readable medium of embodiment #20, wherein the instructions further include instructions that, when executed by the computer cause the computer to map an induced shear fracture field and an induced pressure field around each monitoring well based on the LFDAS sensor data.

What is claimed is:

1. A method, comprising:

installing a machine learning model in a computer system, the machine learning model trained with external pressure gauge data and LFDAS sensor data to identify pressure communication events in Low Frequency Distributed Acoustic Sensing (LFDAS) sensor data;

establishing, in a reservoir formation, one or more monitoring wells in proximity to a well undergoing well stimulation, each monitoring well including one or more LFDAS sensors;

receiving LFDAS sensor data from the LFDAS sensors of the one or more monitoring wells, the received LFDAS sensor data including data received after start of a well stimulation operation; and identifying, based on the machine learning model and on the received LFDAS sensor data, occurrences of pressure communication events at each monitoring well.

2. The method of claim 1, wherein the LFDAS sensor data includes strain fiber data.

3. The method of claim 1, wherein the method further includes modifying the well stimulation operation based on information associated with the identified pressure communication events.

4. The method of claim 1, wherein the model is a neural network.

5. The method of claim 4, wherein the method further includes detecting one or more pressure communication events at one or more of the monitoring wells and modifying the well stimulation operation based on the detected pressure communication events.

6. The method of claim 1, wherein the method further includes mapping an induced shear fracture field and an induced pressure field around each monitoring well based on the LFDAS sensor data.

7. The method of claim 1, wherein the method further includes detecting one or more pressure communication events at one or more of the monitoring wells and modifying the well stimulation operation based on the detected pressure communication events.

8. A non-transitory computer readable medium storing instructions that, when executed by a computer, cause the computer to:

install a machine learning model in a computer system, the machine learning model trained with external pressure gauge data and in Low Frequency Distributed Acoustic Sensing (LFDAS) sensor data to identify pressure communication events in LFDAS sensor data;

establish, in a reservoir formation, one or more monitoring wells in proximity to a well undergoing well stimulation, each monitoring well including one or more LFDAS sensors;

receive LFDAS sensor data from the LFDAS sensors of the one or more monitoring wells, the received LFDAS sensor data including data received after start of a well stimulation operation; and identify, based on the machine learning model and on the received LFDAS sensor data, occurrences of pressure communication events at each monitoring well.

9. The non-transitory computer readable medium of claim 8, wherein the instructions further include instructions that, when executed by a computer, modify the well stimulation operation based on information associated with the identified pressure communication events.

10. The non-transitory computer readable medium of claim 8, wherein the machine learning model is a neural network.

11. The non-transitory computer readable medium of claim 8, wherein the instructions further include instructions that, when executed by a computer, detect one or more pressure communication events at one or more of the monitoring wells and modify the well stimulation operation based on the detected pressure communication events.

12. The non-transitory computer readable medium of claim 8, wherein the instructions further include instructions that, when executed by a computer, map an induced shear fracture field and an induced pressure field around each monitoring well based on the LFDAS sensor data.

13. The non-transitory computer readable medium of claim 8, wherein the instructions further include instructions that, when executed by a computer, detect one or more pressure communication events at one or more of the monitoring wells and modify the well stimulation operation based on the detected pressure communication events.

* * * * *